US009164450B2

(12) United States Patent
Matsumoto et al.

(10) Patent No.: US 9,164,450 B2
(45) Date of Patent: Oct. 20, 2015

(54) ELECTROPHOTOGRAPHIC MEMBER, FIXING DEVICE, AND ELECTROPHOTOGRAPHIC IMAGE FORMING APPARATUS

(71) Applicant: CANON KABUSHIKI KAISHA, Tokyo (JP)

(72) Inventors: Mamo Matsumoto, Hiratsuka (JP); Katsuhisa Matsunaka, Inagi (JP); Yusuke Baba, Yokohama (JP); Noritaka Inoue, Tokyo (JP); Akeshi Asaka, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/711,971

(22) Filed: May 14, 2015

(65) Prior Publication Data

US 2015/0241822 A1 Aug. 27, 2015

Related U.S. Application Data

(63) Continuation of application No. PCT/JP2014/006103, filed on Dec. 5, 2014.

(30) Foreign Application Priority Data

Dec. 17, 2013 (JP) ..... 2013-260363

(51) Int. Cl.
*G03G 15/20* (2006.01)

(52) U.S. Cl.
CPC ..... *G03G 15/206* (2013.01)

(58) Field of Classification Search
None
See application file for complete search history.

(56) References Cited

U.S. PATENT DOCUMENTS

| | | | | |
|---|---|---|---|---|
| 5,319,427 | A * | 6/1994 | Sakurai et al. | 399/333 |
| 9,037,062 | B2 | 5/2015 | Matsumoto et al. | |
| 2012/0315418 | A1 | 12/2012 | Nakajima et al. | |

FOREIGN PATENT DOCUMENTS

| | | | |
|---|---|---|---|
| JP | 2-150875 | A | 6/1990 |
| JP | 2005-164917 | A | 6/2005 |
| JP | 2005-212318 | A | 8/2005 |
| JP | 2006-267436 | A | 10/2006 |
| JP | 2007-314583 | A | 12/2007 |
| JP | 2012-42787 | A | 3/2012 |
| WO | 2012/029380 | A1 | 3/2012 |

* cited by examiner

*Primary Examiner* — Clayton E Laballe
*Assistant Examiner* — Jas Sanghera
(74) *Attorney, Agent, or Firm* — Fitzpatrick, Cella, Harper & Scinto

(57) ABSTRACT

Provided are an electrophotographic member having excellent durability and an electrophotographic image forming apparatus. The electrophotographic member includes: an elastic layer including a silicone rubber; an intermediate layer including at least one of an aromatic polyimide and an aromatic polyamideimide, and a fluororesin; and a surface layer including a fluororesin, in which the aromatic polyimide or the aromatic polyamideimide is bonded to the silicone rubber through an amide bond-containing group, and in which a carbon atom constituting the amide bond is directly bonded to a carbon atom constituting an aromatic ring in a molecule of the aromatic polyimide or aromatic polyamideimide.

12 Claims, 8 Drawing Sheets

ELECTROPHOTOGRAPHIC MEMBER, FIXING DEVICE, AND ELECTROPHOTOGRAPHIC IMAGE FORMING APPARATUS

CROSS-REFERENCE TO RELATED APPLICATIONS

This application is a continuation of International Application No. PCT/JP2014/006103, filed Dec. 5, 2014, which claims the benefit of Japanese Patent Application No. 2013-260363, filed Dec. 17, 2013.

BACKGROUND OF THE INVENTION

Field of the Invention

The present invention relates to an electrophotographic member that can be used as a fixing member of an image forming apparatus such as a copying machine or a printer, and to a fixing device and an electrophotographic image forming apparatus.

An electrophotographic member to be used as a fixing member of a fixing device in a copying machine, a printer, a facsimile, or the like has hitherto included an elastic layer containing a silicone rubber. In addition, a release layer containing a fluororesin and having excellent releasability of toner or the like has been formed on a surface of the elastic layer. However, the release layer containing a fluororesin has a problem of insufficient adhesiveness to the elastic layer.

In view of the above-mentioned problem, Japanese Patent Application Laid-Open No. 2005-212318 proposes a laminate that includes: a base material (elastic layer) containing a silicone rubber or the like and a metal oxide; and a coating layer containing a fluororesin having a functional group such as a phosphate group formed on the base material, and can be suitably used for a roll in a copying machine, a printer, or the like. In addition, Japanese Patent Application Laid-Open No. 2005-212318 discloses that such configuration may produce an interaction between the fluororesin having a functional group and the metal oxide, resulting in sufficient adhesive strength between the fluororesin and the base material.

Studies made by the present inventors have confirmed that the invention according to Japanese Patent Application Laid-Open No. 2005-212318 has an effect of improving the adhesive strength between the base material (elastic layer) and the coating layer containing a fluororesin formed on a surface thereof. However, the inventors have recognized that the adhesive strength between the elastic layer containing a silicone rubber and a surface layer containing a fluororesin formed on a surface thereof in the fixing member leaves room for further improvement.

That is, in recent years, an electrophotographic image forming apparatus has achieved a higher process speed and a higher energy saving property, and in association with this, fixing temperature has been reduced. Along with this, in a fixing device, a higher pressure force has tended to be applied on paper passing through a nip portion constructed of a fixing member and a pressing member arranged so as to face the fixing member in order to maintain good fixability. In this case, the elastic layer of the fixing member is suddenly compressed when entering the nip portion, which causes bending stress to be applied at an interface between the elastic layer and the release layer. In addition, at a posterior end of the nip portion, bending stress is applied at the interface between the elastic layer and the release layer upon pressure release.

In order to stably exhibit fixing performance for a long period of time in such severe environment, the fixing member has required higher durability.

SUMMARY OF THE INVENTION

Thus, the present invention is directed to providing an electrophotographic member having excellent durability, in which an elastic layer including a silicone rubber and a surface layer including a fluororesin exhibit excellent mutual adhesion and the surface layer is hardly peeled off from the elastic layer even through long-term use, and a manufacturing method therefor.

In addition, the present invention is also directed to providing a fixing device and electrophotographic image forming apparatus contributing to stable formation of an electrophotographic image of high quality.

According to an aspect of the present invention, there is provided an electrophotographic member, including: an elastic layer including a silicone rubber; an intermediate layer including at least one of an aromatic polyimide and an aromatic polyamideimide, and a fluororesin; and a surface layer including a fluororesin, in which the aromatic polyimide or the aromatic polyamideimide is bonded to the elastic layer through an amide bond-containing group, and in which a carbon atom constituting the amide bond is directly bonded to a carbon atom constituting an aromatic ring in a molecule of the aromatic polyimide or aromatic polyamideimide.

According to another aspect of the present invention, there is provided a fixing device, including: a fixing member; a heating device for the fixing member; and a pressing member arranged so as to face the fixing member, in which at least one of the fixing member and the pressing member includes the above-mentioned electrophotographic member.

According to still another aspect of the present invention, there is provided an electrophotographic image forming apparatus, including the above-mentioned fixing device.

According to yet another aspect of the invention, there is provided a method of manufacturing an electrophotographic member including: an elastic layer including a silicone rubber; an intermediate layer including at least one of an aromatic polyimide and an aromatic polyamideimide, and a fluororesin; and a surface layer including a fluororesin, the method including the steps of:

(1) preparing an elastic layer containing an amino group on a surface thereof and including the silicone rubber;

(2) forming on the surface of the elastic layer a layer of a mixture of materials for forming an intermediate layer including a polyamic acid as a precursor of an aromatic polyimide or an aromatic polyamideimide, and a fluororesin, followed by forming on the layer of the mixture of materials for forming the intermediate layer a layer of a fluororesin particle dispersion; and (3) imidizing the polyamic acid in the layer of the mixture of materials for forming the intermediate layer, and melting fluororesin particles in the layer of the fluororesin particle dispersion to form a fluororesin layer, the step (3) including the step of allowing an acid group directly bonded to a carbon atom constituting an aromatic ring in a molecule of the polyamic acid to react with the amino group on the surface of the elastic layer when imidizing the polyamic acid.

According to the present invention, it is possible to provide an electrophotographic member having excellent durability, in which an elastic layer including a silicone rubber and a surface layer including a fluororesin exhibit excellent mutual adhesion and the surface layer is hardly peeled off from the elastic layer even through long-term use, and a manufacturing method therefor.

In addition, according to the present invention, it is possible to provide a fixing device and an electrophotographic image forming apparatus contributing to stable formation of an electrophotographic image of high quality.

Further features of the present invention will become apparent from the following description of exemplary embodiments with reference to the attached drawings.

DESCRIPTION OF THE EMBODIMENTS

Preferred Embodiments of the Present Invention will now be described in detail in accordance with the accompanying drawings.

(1) Electrophotographic Image Forming Apparatus

Figure 2A:
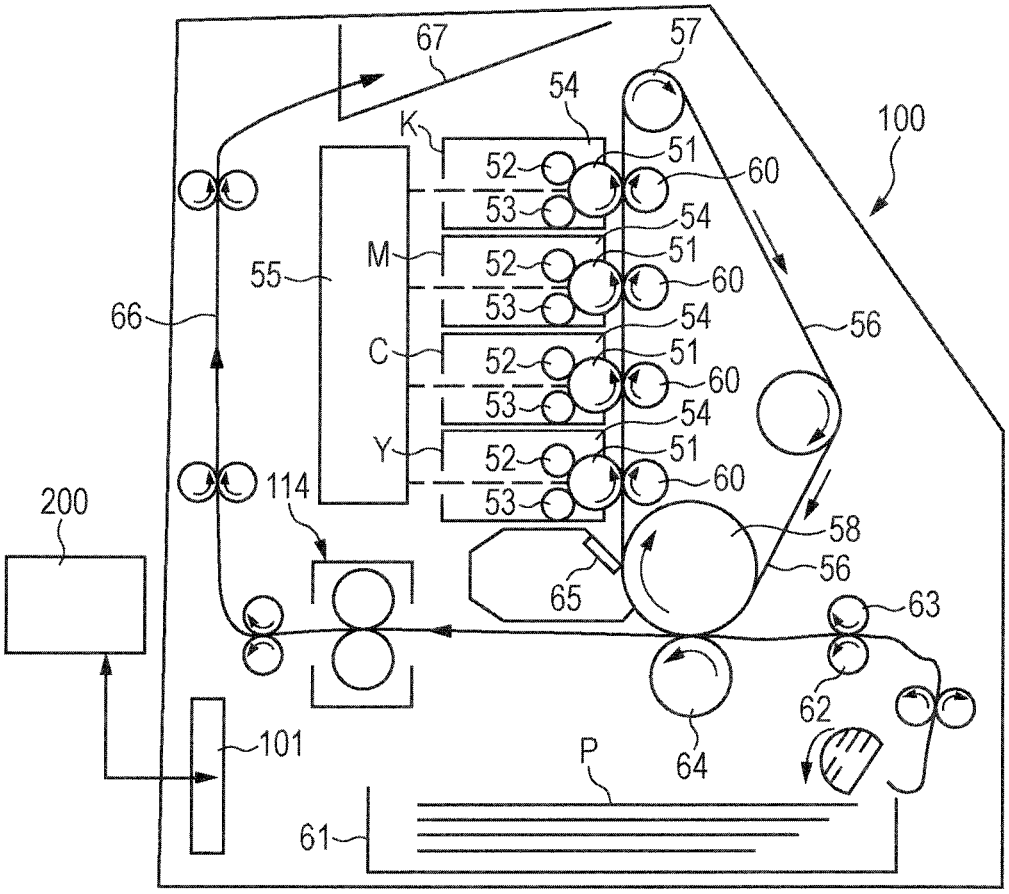
FIG. 2A is a schematic view illustrating an example of a configuration of an image forming apparatus according to the present invention.

FIG. 2A is a schematic structural view illustrating an example of an electrophotographic image forming apparatus (hereinafter also referred to simply as "image forming apparatus") 100 equipped with an image heating and fixing device 114 using a fixing film as a fixing member according to the present invention, as a fixing device configured to fix an unfixed toner image on a recording material through heat treatment.

The image forming apparatus 100 is a color printer of an electrophotographic type. The image forming apparatus 100 is configured to form a color image on a sheet-shaped recording material P as a recording medium based on an electrical image signal to be input from an external host apparatus 200 such as a personal computer or an image reader to a control circuit portion (control means) 101 on an image forming apparatus side. The control circuit portion 101 includes a CPU (processing unit), a ROM (memory means), and the like, and is configured to communicate various electrical information with the external host apparatus 200 or an operation portion (not shown) of the image forming apparatus 100. In addition, the control circuit portion 101 is configured to totally control image forming operation of the image forming apparatus 100 in accordance with a predetermined control program or a predetermined reference table.

Four image forming portions Y, C, M, and K are respectively configured to form color toner images of yellow, cyan, magenta, and black, and are arrayed in the image forming apparatus in this order from bottom up. The image forming portions Y, C, M, and K each include an electrophotographic photosensitive drum 51 as an image bearing member, and a charging device 52, a developing device 53, a cleaning device 54, and the like as process means acting on the drum 51.

The developing device 53 of the yellow image forming portion Y contains a yellow toner as a developer. The developing device 53 of the cyan image forming portion C contains a cyan toner as a developer. In addition, the developing device 53 of the magenta image forming portion M contains a magenta toner as a developer. Further, the developing device 53 of the black image forming portion K contains a black toner as a developer.

An optical system 55 configured to form an electrostatic latent image through exposure to the drum 51 is provided correspondingly to the above-mentioned four color image forming portions Y, C, M, and K. The optical system 55 includes a laser optical system. The optical system 55 performs scanning of laser light modulated based on image data with respect to the drum 51 uniformly charged by the charging device 52 in each of the image forming portions Y, C, M, and K. Thus, an electrostatic latent image corresponding to an image pattern is formed on a surface of the drum 51.

Then, the developing device 53 develops the electrostatic latent image into a toner image. Specifically, an yellow toner image corresponding to a yellow component image in a full-color image is formed on the surface of the drum 51 of the image forming portion Y corresponding to yellow, a cyan toner image corresponding to a cyan component image in a full-color image is formed on the surface of the drum 51 of the image forming portion C corresponding to cyan, a magenta toner image corresponding to a magenta component image in a full-color image is formed on the surface of the drum 51 of the image forming portion M corresponding to magenta, and a black toner image corresponding to a black component image in a full-color image is formed on the surface of the drum 51 of the image forming portion K corresponding to black.

In synchronism with rotation of each of the drums 51, the above-mentioned color toner image formed on the surface of the drum 51 of each of the image forming portions Y, C, M, and K is primarily transferred onto an intermediate transfer member 56 rotated at a substantially constant speed in a manner that the above-mentioned color toner images are sequentially superimposed in a predetermined alignment. In this way, the above-mentioned color toner images are combined and formed into an unfixed full-color toner image on the intermediate transfer member 56. In the exemplary embodiment, an endless intermediate transfer belt is used as the intermediate transfer member 56. The intermediate transfer member 56 is stretched around the following three rollers: a driving roller 57; an opposed secondary transfer roller 58; and a tension roller 59, and is driven by the driving roller 57. A primary transfer roller 60 is used as a unit configured to perform primary transfer of the toner image from the surface of the drum 51 of each of the image forming portions Y, C, M, and K onto the belt 56. A bias power source (not shown) applies a primary transfer bias having a polarity reverse to those of the toners to the roller 60. In this way, the toner image is primarily transferred from the surface of the drum 51 of each of the image forming portions Y, C, M, and K onto the belt 56.

In each of the image forming portion Y, C, M, and K, after the toner image is primarily transferred from the surface of the drum 51 onto the belt 56, the cleaning device 54 removes untransferred residual toner remaining on the surface of the drum 51. In synchronism with the rotation of the belt 56, the step described above is performed with respect to each of the colors of yellow, magenta, cyan, and black. Primarily transferred toner images of those colors are formed by being sequentially superimposed onto the belt 56 in this way.

It is to be noted that, in order to perform monochromatic image formation (monochromatic mode), the step described above is performed with respect only to a selected color. Meanwhile, at a predetermined timing, a feed roller 62 separates one by one and feeds a recording material P received in a recording material cassette 61. Then, at a predetermined timing, a registration roller pair 63 conveys the recording material P into a transfer nip portion at which a part of the intermediate transfer belt, which is hooked to the opposed secondary transfer roller 58, and a secondary transfer roller 64 are brought into press contact with each other.

The primarily-transferred combined toner image formed on the belt 56 is secondarily transferred in a collective manner onto the recording material P with a bias applied from a bias power source (not shown) to the secondary transfer roller 64 and having a polarity reverse to those of the toners. An intermediate transfer belt cleaning device 65 removes untransferred residual toner remaining on the belt 56 after the secondary transfer. The unfixed toner image secondarily transferred on the recording material P is fixed onto the recording material P while being molten and mixed in color by a fixing device 114, and then delivered as a full-color print onto a delivery tray 67 via a delivery path 66.

(2) Image Heating and Fixing Device

Figure 2B:
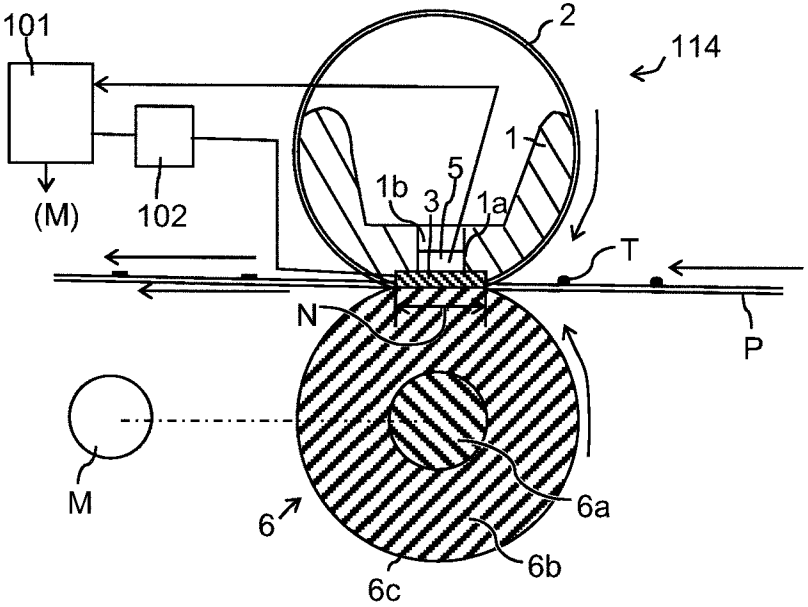
FIG. 2B is a schematic transverse sectional view schematically illustrating an image heating and fixing device according to the present invention.

FIG. 2B is a schematic transverse sectional view of a main portion of the image heating and fixing device 114 using a fixing film as a fixing member according to the present invention. In the following description in relation to the image heating and fixing device and its constituent members, the "longitudinal direction" means a direction perpendicular to a recording material conveying direction in plane of the recording material. The "lateral direction" means a direction parallel to the recording material conveying direction in plane of the recording material. The "width" means the dimension of the recording material in the lateral direction. The "length" means the dimension of the recording material in the longitudinal direction. The image heating and fixing device 114 in this embodiment is basically an image heating and fixing device of a so-called tensionless film heating type, which is a known technology. An image heating and fixing device of this film heating type uses as a fixing member a heat-resistant flexible fixing film 2 having an endless belt shape or a cylindrical shape. In the device, at least a part of a peripheral portion of the fixing film 2 is always free from any tension (in a state in which no tension is applied), and the fixing film 2 is configured to be driven to rotate by a rotation driving force of a pressure roller (pressure rotating member) 6 as a pressing member. In this embodiment, the fixing film 2 as a fixing member corresponds to a film having a configuration according to the present invention.

In FIG. 2B, a stay 1 serves concurrently as a heating member-supporting member and a film guiding member. The stay 1 is a rigid member made of a heat-resistant resin that is elongated in the longitudinal direction (in a direction perpendicular to the figure) and has an approximately semicircular gutter shape in its transverse section. In this embodiment, a highly heat-resistant liquid crystal polymer is used as a material for the stay 1. In addition, in the vicinity of a center portion of the stay 1 in the longitudinal direction, a hole 1*b* for storing a thermistor (temperature detecting element) 5 to be arranged in contact with a heater 3 is provided in communication with a groove portion 1*a*. In this embodiment, the heater 3 is a so-called ceramic heater, and is engaged in and fixedly supported by the groove portion 1*a* provided at a central portion in the lateral direction on the bottom surface of the stay 1 along the longitudinal direction of the stay 1. The highly heat-resistant flexible fixing film 2 having a cylindrical shape as a fixing member is loosely engaged outside the outer periphery of the stay 1 supporting the heater 3 with leaving a peripheral margin.

In addition, grease is applied onto the inner peripheral surface (inner surface) of the fixing film 2 in order to improve slidability with respect to the heater 3. The stay 1, the heater 3, the fixing film 2, and the like construct a heating assembly 4. The pressure roller (pressure rotating member) 6 serves as a back-up member. The pressure roller 6 in this embodiment is prepared by coating a round shaft core metal 6*a* made of iron, stainless steel, aluminum, or the like with a silicone foam member as a heat-resistant elastic layer 6*b*, and then coating the elastic layer 6*b* with a fluororesin tube as a release layer 6*c*. The pressure roller 6 faces the heater 3 held in the stay 1 across the fixing film 2. In addition, a predetermined pressure is applied between the stay 1 and the pressure roller 6 by a pressure mechanism (not shown). By the pressure, the elastic layer 6*b* of the roller 6 is elastically deformed in the longitudinal direction along the heater 3 across the fixing film 2. As a result, a nip portion (fixing nip portion) N having a predetermined width necessary to heat fix the unfixed toner image T to be carried by the recording material P is created between the roller 6 and the heater 3 with the fixing film 2 interposed therebetween.

The pressure roller 6 is driven to rotate at a predetermined speed in the counterclockwise direction indicated by an arrow of FIG. 2B by a motor (drive means) M to be controlled by the control circuit portion 101 at least during execution of image formation. By a frictional force caused in the nip portion N between the pressure roller 6 and the fixing film 2 by the rotation of the pressure roller 6, a rotation force acts on the fixing film 2. With this, the fixing film 2 rotates outside the stay 1 in the clockwise direction indicated by an arrow of FIG. 2B at a peripheral speed approximately corresponding to the rotation peripheral speed of the pressure roller 6, while its inner surface slides in close contact with a surface of the heater 3 in the nip portion N. Specifically, the fixing film 2 is allowed to rotate at a peripheral speed approximately the same as a conveying speed of the recording material P, carrying thereon the unfixed toner image T, which is conveyed from an image transfer portion side. In addition, the heater 3 is increased in temperature by being supplied with electric power from a power source device 102. The temperature of the heater 3 is detected with the thermistor 5. The detected temperature information is fed back to the control circuit portion 101. The control circuit portion 101 is configured to control the electric power to be input from the power source device 102 to the heater 3 so that the detected temperature to be input from the thermistor 5 is kept at a predetermined target temperature (fixing temperature). In a state in which the heater 3 is heated to and temperature-controlled at a predetermined fixing temperature and the roller 6 is driven to rotate, the recording material P carrying thereon the unfixed toner image T is introduced in the nip portion N with its surface side on which the toner image is carried kept toward the fixing film 2 side. The recording material P is brought into close contact with the outer surface of the fixing film 2 in the nip portion N, and nip-conveyed through the nip portion N together with the fixing film 2. As a result, the heat of the heater 3 is applied to the recording material P through the fixing film 2, and a pressure force is applied to the recording material P in the nip portion N. Thus, the unfixed toner image T is fixed by heat and pressure onto the surface of the recording material P. The recording material P that has passed through the nip portion N is self-separated from the outer peripheral surface of the fixing film 2 and is conveyed outside the fixing device.

(3) Configuration of Fixing Film

Figure 1:
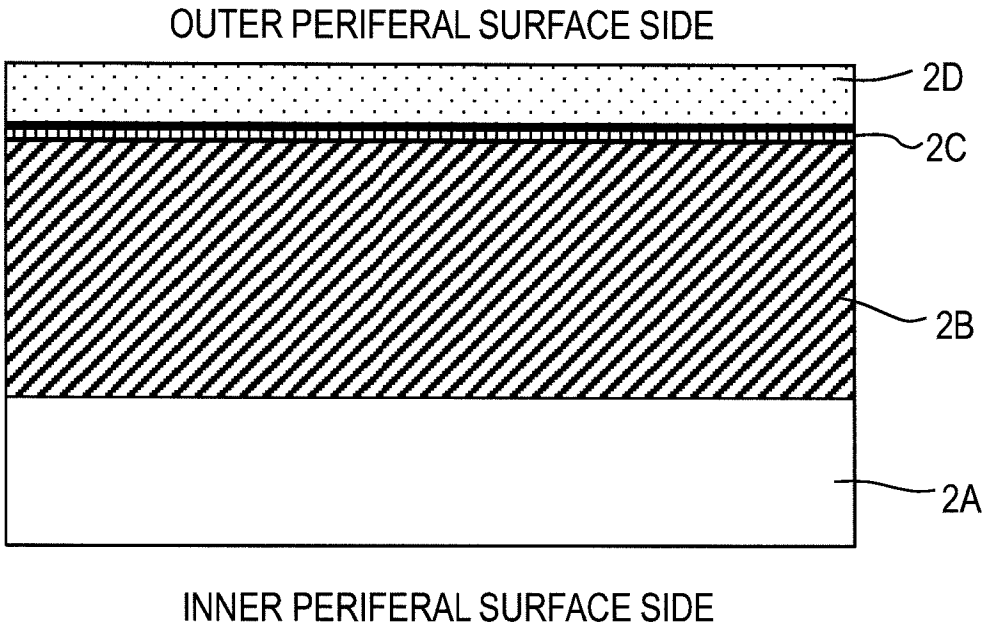
FIG. 1 is a schematic sectional view illustrating a layer structure in a fixing film as a heat fixing member according to the present invention.

FIG. 1 is a schematic sectional view illustrating a layer structure in a part of the fixing film 2 serving as a fixing member of the above-mentioned fixing device 114. A base material 2A of the fixing film 2 is an endless belt member made of a metal or a heat-resistant resin. The total thickness of the fixing film 2 is preferably smaller from the viewpoints of reducing a heat capacity and improving a quick start property. A smaller thickness of the base material 2A is also advantageous for the quick start of the fixing device 114. However, an extremely small thickness offers insufficient strength, and hence the thickness of the base material 2A is desirably from 20 to 100 μm. In addition, an elastic layer 2B is formed on the outer peripheral surface of the base material 2A. The elastic layer 2B plays a role in conducting heat from the heater 3 to the recording material P or the unfixed toner image T by following and covering irregularities on the recording material P or the unfixed toner image T. As a material for the elastic layer 2B, a heat-resistant rubber in which a filler having high thermal conductivity is mixed may be used.

A smaller thickness of the elastic layer 2B is also advantageous for the quick start of the fixing device 114. In addition, from the viewpoint of ensuring the covering effect on the recording material P or toner, the thickness of the elastic layer 2B preferably ranges from 50 μm to 1 mm, particularly preferably from 80 μm to 300 μm.

A release layer (surface layer) 2D serving as an outermost layer of the fixing film 2 is formed of a fluororesin having good releasability in order to prevent offset of the unfixed toner image T on the recording material P. In addition, an intermediate layer 2C and a primer layer 2C are formed between the elastic layer 2B and the surface layer 2D. With a view to easily conducting the heat from the heater 3 to the recording material P and the unfixed toner image T, the total thickness of the intermediate layer 2C, the primer layer 2C, and the surface layer 2D is desirably 25 μm or less.

(3-1) Base Material 2A

As a material for the base material 2A, a metal such as stainless steel (SUS), nickel, or a nickel alloy may be used. A polyimide, a polyamideimide, or the like, which is a thermosetting resin having high heat resistance, strength, durability, and the like, may be used as well.

(3-2) Elastic Layer 2B

The elastic layer 2B contains a silicone rubber.

(3-2-1) Silicone Rubber

An addition curing type liquid silicone rubber composition containing an addition curing type liquid silicone rubber (hereinafter also referred to simply as "addition curing type silicone rubber composition") is preferably used for forming the elastic layer according to the present invention by virtue of its excellent processability. That is, the elastic layer according to the present invention preferably contains a cured product of the addition curing type silicone rubber composition.

In the present invention, the addition curing type silicone rubber composition to be used for forming the elastic layer 2B contains as basic constituent components components according to the following items (a), (b), and (c):

(a) an organopolysiloxane having an unsaturated aliphatic group;

(b) an organopolysiloxane having active hydrogen bonded to silicon; and (c) a platinum compound as a cross-linking catalyst.

Examples of the organopolysiloxane having an unsaturated aliphatic group according to the above-mentioned item (a) include the following organopolysiloxanes.

Linear organopolysiloxane in which both of its molecular terminals are represented by $R^1{}_2R^2SiO_{1/2}$, and its intermediate unit is represented by $R^1{}_2SiO$ and $R^1R^2SiO$ Branched organopolysiloxane in which both of its molecular terminals are represented by $R^1{}_2R^2SiO_{1/2}$, and its intermediate unit contains $R^1SiO_{3/2}$ and/or $SiO_{4/2}$ Herein, $R^1$ represents a monovalent unsubstituted or substituted hydrocarbon group that does not contain an aliphatic unsubstituted group, which is bonded to a silicon atom. Specific examples thereof include alkyl groups (such as a methyl group, an ethyl group, a n-propyl group, a n-butyl group, a n-pentyl group, and a n-hexyl group), aryl groups (a phenyl group and a naphthyl group), and substituted hydrocarbon groups (such as a chloromethyl group, a 3-chloropropyl group, a 3,3,3-trifluoropropyl group, a 3-cyanopropyl group, and a 3-methoxypropyl group).

In particular, it is preferred that 50% or more of $R^1$'s represent a methyl group, and it is more preferred that all of $R^1$'s represent a methyl group, because of easy synthesis and easy handleability, and excellent heat resistance.

In addition, $R^2$ represents an unsubstituted aliphatic group, which is bonded to a silicon atom. Examples of $R^2$ include a vinyl group, an aryl group, a 3-butenyl group, a 4-pentenyl group, and a 5-hexenyl group. In particular, a vinyl group is preferred because of easy synthesis and easy handleability, and ease of a cross-linking reaction of the silicone rubber.

The organopolysiloxane having active hydrogen bonded to silicon according to the above-mentioned item (b) is a cross-linking agent for forming a cross-linked structure by reacting with an alkenyl group in the organopolysiloxane component having an unsaturated aliphatic group according to the above-mentioned item (a) by the catalytic action of the platinum compound.

In the organopolysiloxane having active hydrogen bonded to silicon according to the above-mentioned item (b), the number of hydrogen atoms bonded to a silicon atom per molecule preferably exceeds three on average. An organic group bonded to the silicon atom is exemplified by the same substituted or unsubstituted monovalent hydrocarbon group as that represented by $R^1$ of the organopolysiloxane component having an unsaturated aliphatic group. In particular, a methyl group is preferred by virtue of easy synthesis and easy handleability. The molecular weight of the organopolysiloxane having active hydrogen bonded to silicon is not particularly limited. In addition, the viscosity of the organopolysiloxane having active hydrogen bonded to silicon according to the above-mentioned item (b) at 25° C. falls within a range of preferably 10 $mm^2/s$ or more and 100,000 $mm^2/s$ or less, more preferably 15 $mm^2/s$ or more and 1,000 $mm^2/s$ or less. When the viscosity is 10 $mm^2/s$ or more, the organopolysiloxane hardly evaporates during its storage, and the silicone rubber to be obtained can achieve a desired degree of cross-linking and desired physical properties. In addition, when the viscosity is 100,000 $mm^2/s$ or less, the organopolysiloxane is easily handled, and can be dispersed in a system easily and uniformly.

In addition, the siloxane skeleton of the organopolysiloxane having active hydrogen bonded to silicon according to the above-mentioned item (b) may be any of a linear, branched, or cyclic one, and a mixture thereof may be used. In particular, a linear one is preferred from the viewpoint of ease of synthesis.

Further, in the organopolysiloxane having active hydrogen bonded to silicon according to the above-mentioned item (b), a Si—H bond may be present in any siloxane unit in the organopolysiloxane molecule, but at least a part thereof is preferably present at a terminal of the organopolysiloxane molecule, such as an $R^1{}_2HSiO_{1/2}$ unit.

The organopolysiloxane having an unsaturated aliphatic group according to the above-mentioned item (a) and the organopolysiloxane having active hydrogen bonded to silicon according to the above-mentioned item (b) are preferably blended in the addition curing type silicone rubber composition so that the ratio of the number of unsaturated aliphatic groups to the number of silicon atoms is 0.001 or more and 0.020 or less, more preferably 0.002 or more and 0.010 or less.

In addition, the organopolysiloxane having an unsaturated aliphatic group according to the above-mentioned item (a) and the organopolysiloxane having active hydrogen bonded to silicon according to the above-mentioned item (b) are preferably blended so that the ratio of the number of active hydrogens to the number of unsaturated aliphatic groups is 0.3 or more and 0.8 or less. When the ratio of the number of active hydrogens to the number of unsaturated aliphatic groups is 0.3 or more, the silicone rubber after being cured can stably achieve a desired hardness. In addition, the ratio of the number of active hydrogens to the number of unsaturated aliphatic groups is 0.8 or less, an excess increase in the hardness of the silicone rubber can be prevented. The ratio of the number of active hydrogens to the number of unsaturated aliphatic groups may be calculated based on quantitative determination of the number of unsaturated aliphatic groups and the number of active hydrogens using hydrogen nuclear magnetic resonance analysis (1H-NMR (trade name: AL400-type FT-NMR; manufactured by JEOL Ltd.)).

In the present invention, the material for the elastic layer 2B is not limited to an addition curing type silicone rubber, and a condensation-curable silicone rubber may be used. In the case of using a condensation-curable silicone rubber, a curing time and characteristics thereof may be unstable depending on the humidity, temperature, and the like of an operation environment. Therefore, it is desired to use a curing agent together in order to keep curing stability particularly in a deep portion.

(3-2-2) Filler in Elastic Layer 2B

As a specific example of the filler that can be incorporated into the elastic layer 2B for enhancing the thermal conductivity of the elastic layer, there is given metal silicon, alumina, zinc oxide, silicon carbide, or the like. Those fillers may be used alone, or at least two or more fillers selected therefrom may be used in combination.

(3-3) Intermediate Layer 2C

An electrophotographic member according to the present invention includes the intermediate layer 2C between the elastic layer 2B and the surface layer 2D for improving adhesiveness between the elastic layer 2B and the surface layer 2D.

The intermediate layer 2C contains a fluororesin, and contains at least one of an aromatic polyimide resin and an aromatic polyamideimide resin.

At least one kind selected from the group consisting of the following resins is desired as the fluororesin: polytetrafluoroethylene (PTFE), a tetrafluoroethylene-perfluoroalkyl vinyl ether copolymer (PFA), and a tetrafluoroethylene-hexafluoropropylene copolymer (FEP).

In addition, examples of the aromatic polyimide resin material may include: thermosetting resins such as a polypyromellitimide-based polyimide resin material and a polybiphenyltetracarboxylic imide-based resin material; and thermoplastic polyimide resins such as a polybenzophenonetetracarboxylic imide-based resin material and a polyether imide resin.

The fluororesin and the aromatic polyimide and/or the aromatic polyamideimide are present in the intermediate layer in a state in which the fluororesin and the aromatic polyimide and/or the aromatic polyamideimide are sufficiently well compatible with each other. As a result, the surface layer and the intermediate layer each containing a fluororesin can maintain high mutual adhesion.

Further, when the intermediate layer contains the aromatic polyimide and/or the aromatic polyamideimide, an amide bond-containing group is formed between the elastic layer 2B and the polyimide resin, as described later. More specifically, there is formed an aromatic amide bond in which a carbon atom constituting the amide group is directly bonded to a carbon atom constituting an aromatic ring in the molecule of the polyimide. With this, the adhesiveness between the elastic layer and the intermediate layer can be also increased.

(3-4) Surface Layer 2D

The fluororesin for the surface layer (release layer) 2D is insoluble in a solvent because the fluororesin is formed of a fluororesin mixture containing a crystalline fluororesin. Therefore, the fluororesin is used as a dispersion in which fine particles of the fluororesin are dispersed in a solvent such as water (coating material).

The crystalline fluororesin has high heat resistance and high durability, and generally has a melting point of 200° C. or more. In the case of using the crystalline fluororesin in the fixing member of the present invention, it is preferred that the crystalline fluororesin can withstand a temperature of 200° C. or more even in continuous use.

In general, a polymer partly melts even at a temperature equal to or lower than its melting point. A temperature range in which a resin melts expands around its melting point with some width. Therefore, the fluororesin constituting the surface layer preferably has a melting point of 250° C. or more in order to suppress deterioration of the surface layer in long-term and continuous use.

A specific example of such fluororesin may be at least one selected from the group consisting of polytetrafluoroethylene (PTFE), a tetrafluoroethylene-perfluoro(alkyl vinyl ether) copolymer (PFA), a tetrafluoroethylene-hexafluoropropylene copolymer (FEP), and copolymers and modified resins thereof.

In particular, PFA is a most suitable material as the fluororesin to be used in the present invention because PFA has a melting point of from 280° C. to 320° C., and has quite satisfactory heat resistance and satisfactory processability.

The type of copolymerization of PFA is not particularly limited, and examples thereof include random copolymerization, block copolymerization, and graft copolymerization. In addition, the molar ratio between contents of tetrafluoroethylene (TFE) and perfluoroalkyl vinyl ether (PAVE) in PFA is not particularly limited. Specifically, PFA having a molar ratio between contents of TFE and PAVE of from 94/6 to 99/1 may be suitably used.

In addition, specific examples of PAVE include perfluoro(methyl vinyl ether) (PMVE) and perfluoro(ethyl vinyl ether) (PEVE).

(4) Method of Manufacturing Fixing Film (4-1) Formation of Elastic Layer 2B

The elastic layer 2B is formed on the base material 2A preliminarily treated with a primer.

Figure 3:
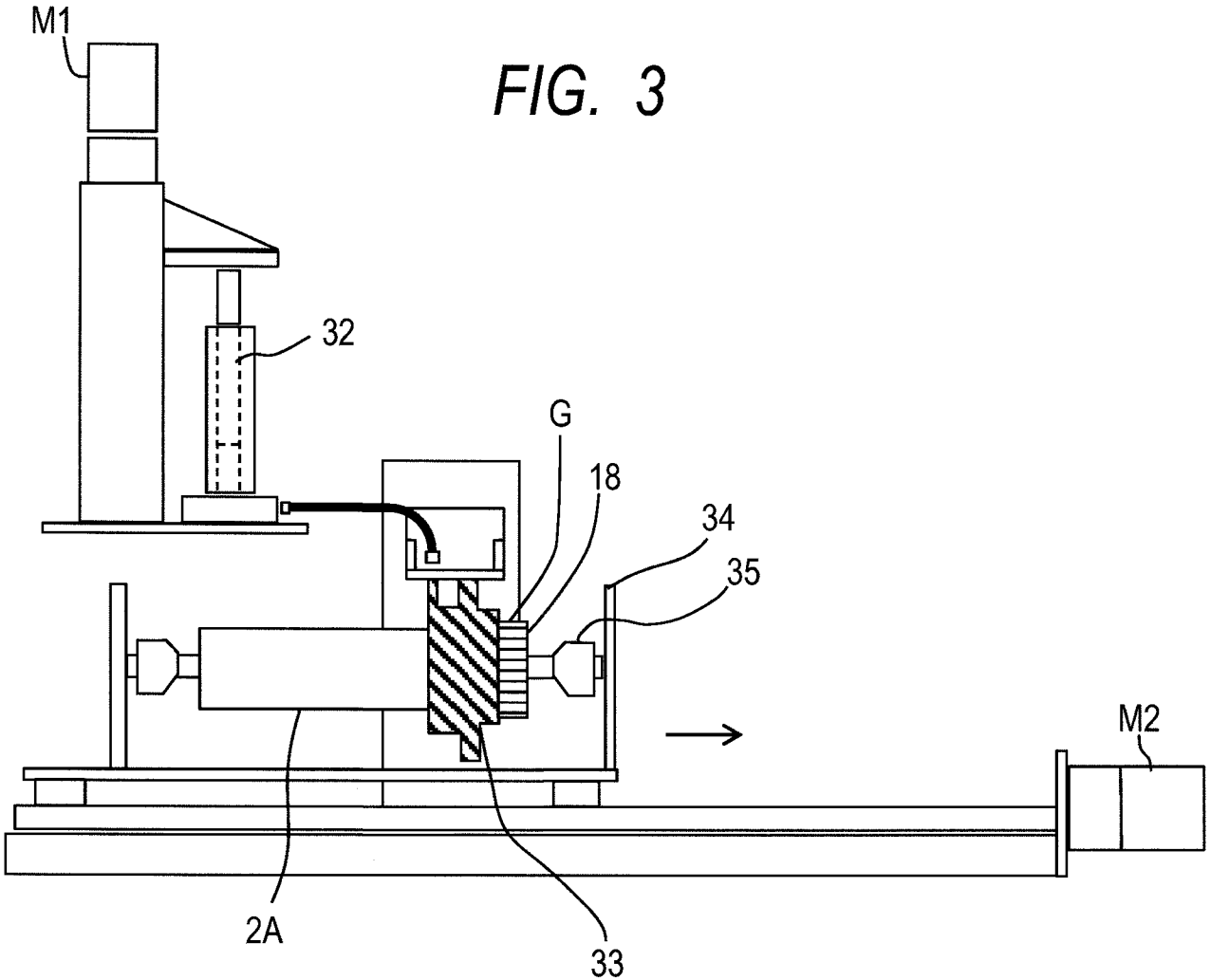
FIG. 3 is a schematic view of a ring coating machine for producing the fixing film.

As a method of forming the elastic layer 2B, for example, a ring coating method may be used. FIG. 3 is a view illustrating an example of a step of forming on the base material 2A a silicone rubber layer to serve as the elastic layer 2B, and is a schematic view for illustrating a so-called ring coating method. The base material 2A, which is an endless belt member, is allowed to cover a cylinder-shaped core cylinder 18 having a cross-section of a true circle having a length approximately the same as the inner peripheral length of the base material 2A, and is mounted on the core cylinder 18 so that the base material 2A is prevented from being loosened. Next, the core cylinder 18 having mounted thereon the base material 2A is fixed on a movable stage 34 with a chucking attachment 35. The addition curing type silicone rubber composition that contains the addition curing type silicone rubber and the filler having high thermal conductivity and thus has high thermal conductivity is filled in a cylinder pump 32. Then, the composition is fed by pressure with a pressure motor M1, to be applied onto the peripheral surface of the base material 2A with an application liquid feed nozzle 33. At this time, the movable stage 34 including the base material 2A and core cylinder 18 fixed thereon is moved at a constant speed in a right direction of FIG. 3 (indicated by the arrow) by a drive motor M2 simultaneously with the application. With this, a coating of an addition curing type silicone rubber composition G to serve as the elastic layer 2B can be formed on the entire outer peripheral surface of the base material 2A.

The thickness of the coating to serve as the elastic layer 2B can be controlled by a clearance between the application liquid feed nozzle 33 and the surface of the base material 2A, a feed speed of the silicone rubber composition, a moving speed of the base material 2A (stage 34), or the like. The addition curing type silicone rubber layer formed on the base material 2A is heated for a certain period of time by heretofore known heating means such as an electric furnace or an infrared heater, to proceed with a cross-linking reaction. Thus, the silicone rubber layer can be formed into the elastic layer 2B that is a cured silicone rubber layer.

The method of forming the elastic layer 2B is not limited to the above-mentioned ring coating method. For example, there may be used a method involving applying onto a metal layer a material such as the liquid silicone rubber by means such as a blade coating method to form a coating having a uniform thickness, followed by heat curing. Alternatively, there may be used: a method involving pouring the material such as the liquid silicone rubber in a mold, followed by heat curing; a method involving extrusion molding the material, followed by heat curing; a method involving injection molding the material, followed by heat curing; or the like.

(4-2) Surface Treatment (1) on Elastic Layer

The surface of the elastic layer 2B is desirably subjected to surface treatment prior to formation of the intermediate layer 2C. For example, hydrophilic treatment such as UV treatment (ultraviolet light irradiation treatment) is desirably performed. The UV treatment, which is not essential, facilitates film formation after this step by rendering the surface of the silicone rubber layer hydrophilic.

(4-3) Surface Treatment (2) on Elastic Layer

The surface of the elastic layer 2B after being subjected to the above-mentioned surface treatment (coating pretreatment) is subjected to surface treatment with an aminosilane coupling agent. Specifically, an aminosilane coupling agent is uniformly applied onto the surface of the elastic layer 2B by spraying or the like, and then dried in an environment of normal temperature and normal humidity. With this, a layer of an amino group-containing polysiloxane can be formed on the surface of the elastic layer.

Any known silane coupling agent may be used as the amino group-containing silane coupling agent. Specific examples thereof include 3-aminopropyltrimethoxysilane, 3-aminopropyltriethoxysilane, N-(2-aminoethyl)-3-aminopropylmethyldimethoxysilane, N-(2-aminoethyl)-3-aminopropyltrimethoxysilane, N-2-(aminoethyl)-3-aminopropyltriethoxysilane, N-phenyl-3-aminopropyltrimethoxysilane, 3-aminopropylmethylbis(trimethylsiloxy)silane, 3-aminopropyldimethylethoxysilane, 3-aminopropylmethyldiethoxysilane, and 4-aminobutyltriethoxysilane.

At least one amino-modified silane coupling agent selected from an amino-modified silane coupling agent having a structure represented by the following structural formula (1) and an amino-modified silane coupling agent having a structure represented by the following structural formula (2) can be more preferably employed.

Structural Formula (1)

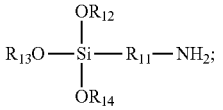

Structural Formula (2)

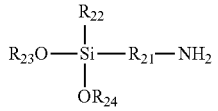

Herein, an alkylene group ($R_{11}$, $R_{21}$) between an amino group and a silicon atom in the silane coupling agent preferably has 1 to 3 carbon atoms. Such alkylene group undergoes less thermal decomposition when the fixing film is exposed to high temperature for a long period of time, and an adhesion failure resulting therefrom can be suppressed.

In addition, it is desired that $R_{12}$, $R_{13}$, $R_{14}$, $R_{23}$, and $R_{24}$ in an alkoxy group in the silane coupling agent each independently represent a hydrogen atom or an alkyl group having 1 or 2 carbon atoms. When such conditions are satisfied, excessive wetting of an application surface caused by delay in evaporation of an alcohol generated by a dehydration condensation reaction can be prevented. As a result, the thickness of the intermediate layer 2C can be prevented from being non-uniform in a step of forming the intermediate layer 2C described later. It is to be noted that $R_{22}$ represents an alkylene group having 1 to 3 carbon atoms.

As the silane coupling agent, one kind of the silane coupling agents may be used alone, or two or more kinds thereof may be used in combination. In addition, the silane coupling agent may be used through dilution with a solvent. Almost any organic solvent such as an alcohol, toluene, xylene, ethyl acetate, methyl ethyl ketone, acetone, or a mixed system of an alcohol and water may be used as the solvent for the dilution.

(4-4) Formation of Layer of Mixture of Materials for Forming Intermediate Layer

The amino-modified silane coupling agent is applied. After a coating of the amino-modified silane coupling agent is dried or while the coating is still slightly wet, a water-based dispersion containing a polyamic acid and a fluororesin (hereinafter also referred to as "mixture of materials for forming the intermediate layer") is applied onto the coating of the amino-modified silane coupling agent by spraying, followed by drying. The thickness of a layer of the mixture of materials for forming the intermediate layer after the drying is preferably from about 1 to 2 μm.

As the fluororesin to be used in the mixture of materials for forming the intermediate layer, there may be used, for example, a copolymer resin of tetrafluoroethylene and perfluoro(alkyl vinyl ether) (PFA), a copolymer resin of tetrafluoroethylene and hexafluoropropylene (FEP), a copolymer thereof, or a modified resin thereof.

In addition, the fluororesins to be incorporated into the surface layer and the intermediate layer are preferably of the same kind. This enables a further improvement in the adhesiveness between the intermediate layer and the surface layer. Therefore, when PFA is used as the fluororesin in the surface layer (release layer) as described above, it is preferred that the fluororesin to be incorporated into the mixture of materials for forming the intermediate layer be also PFA.

When PFA is incorporated into the mixture of materials for forming the intermediate layer, the type of copolymerization of PFA is not particularly limited, and examples thereof include random copolymerization, block copolymerization, and graft copolymerization. In addition, the molar ratio between contents of tetrafluoroethylene (TFE) and perfluoroalkyl vinyl ether (PAVE) in PFA is not particularly limited. Specifically, PFA having a molar ratio between contents of TFE and PAVE of from 94/6 to 99/1 may be suitably used. In addition, specific examples of PAVE include perfluoro(methyl vinyl ether) (PMVE) and perfluoro(ethyl vinyl ether) (PEVE).

As the polyamic acid, there may be used, for example, a precursor of the aromatic polyimide or the aromatic polyamideimide, having a structure represented by the following structural formula (3) or (4) as a part of its repeating units.

Structural Formula (3)

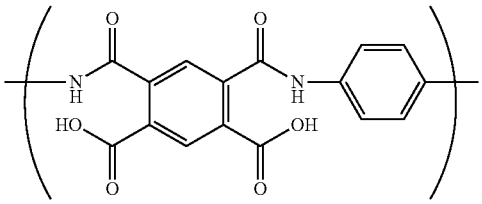

Structural Formula (4)

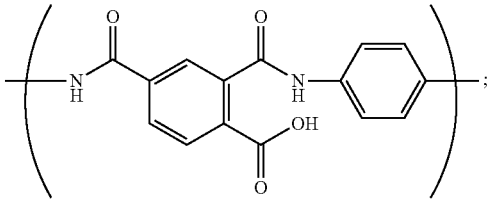

In addition, from the viewpoint of a film formation property, a component such as a surfactant having a branched alkyl chain and an ethylene oxide (EO) chain, a solvent, or water is desirably contained in addition to those components.

(4-5) Application of Fluororesin Particle Dispersion (Coating Material) for Forming Release Layer 2D The fluororesin for the surface layer 2D is insoluble in a solvent because the fluororesin is formed of a fluororesin mixture containing a crystalline fluororesin. Therefore, the fluororesin is used as a dispersion in which fine particles of the fluororesin are dispersed in a solvent such as water (coating material).

Such fluororesin dispersion for the release layer (coating material) is further applied onto the surface of the layer of the mixture of materials for forming the intermediate layer, followed by drying. As a method of applying the fluororesin dispersion for the surface layer 2D, any method may be used as long as the dispersion is leveled on a roller surface to form a smooth unbaked fluororesin layer having small irregularities. As such application method, a spray coating method is particularly preferably used because the method offers easy handleability, but a dipping method or the like may be used. The applied thickness of the unbaked fluororesin layer to serve as the surface layer 2D desirably falls within a range of from 4 μm or more to 25 μm or less, because an excessively large applied thickness is liable to cause cracks during drying or baking after the application, and in contrast, an excessively small applied thickness creates a difficulty in the leveling during the application, and easily leads to a mottled layer.

(4-6) Baking

As baking means for baking the unbaked fluororesin layer to serve as the surface layer 2D, any means may be used as long as the means enables heating at least at a temperature equal to or higher than the melting point of the fluororesin, more desirably heating from the melting point to a temperature about 20° C. to 50° C. higher than the melting point. As a baking method, for example, the following methods may be given: a method involving using an electric oven in which hot air is circulated; a method involving using an infrared heater employing heating by radiation; a method involving locally creating air of high temperature with a cylinder-shaped or coil-shaped heating element or the like, followed by allowing a target to pass through the locally hot air, to bake the target.

In this embodiment, after a primer containing: the polyamic acid having any one kind of structure selected from a structure represented by the structural formula (3) and a structure represented by the structural formula (4); and the fluororesin is applied onto the aminopolysiloxane formed on the surface of the elastic layer and the dispersion for forming the release layer described above is applied thereonto, baking is performed. As a result, the release layer containing the fluororesin and the intermediate layer containing at least one of the aromatic polyimide and the aromatic polyamideimide are formed. Herein, in this baking step, an imidization reaction of the polyamic acid is promoted, and thus the aromatic polyimide or the aromatic polyamideimide is formed. Through the imidization, the precursor of the aromatic polyimide or aromatic polyamideimide reacts with an amino group of the aminopolysiloxane formed on the elastic layer. As a result, the intermediate layer and the elastic layer are bonded to each other with an amide bond-containing group.

Figure 5A:
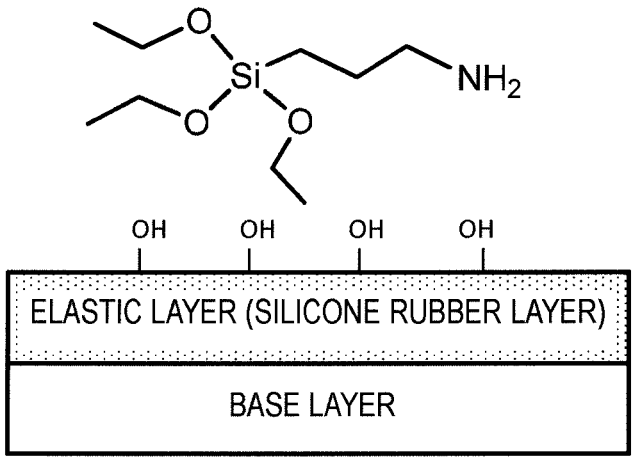
FIG. 5A is an explanatory view of a manufacturing step for an electrophotographic member according to the present invention.
Figure 5B:
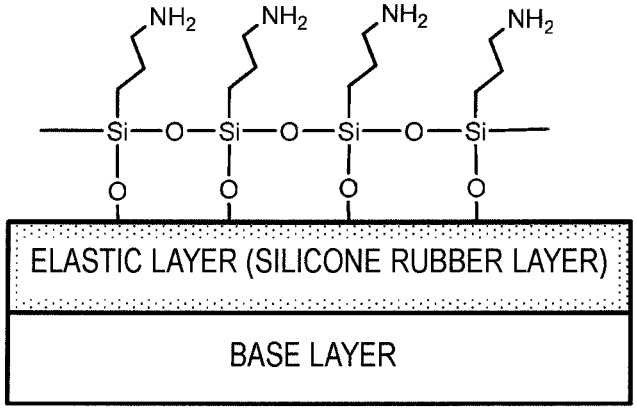
FIG. 5B is an explanatory view of a manufacturing step for the electrophotographic member according to the present invention.

Specifically, when the amino-modified silane coupling agent is applied onto the elastic layer containing the silicone rubber formed on a base layer as illustrated in FIG. 5A, the amino group-containing polysiloxane is formed on the surface of the elastic layer through hydrolysis and condensation of the silane coupling agent as illustrated in FIG. 5B.

Figure 6A:
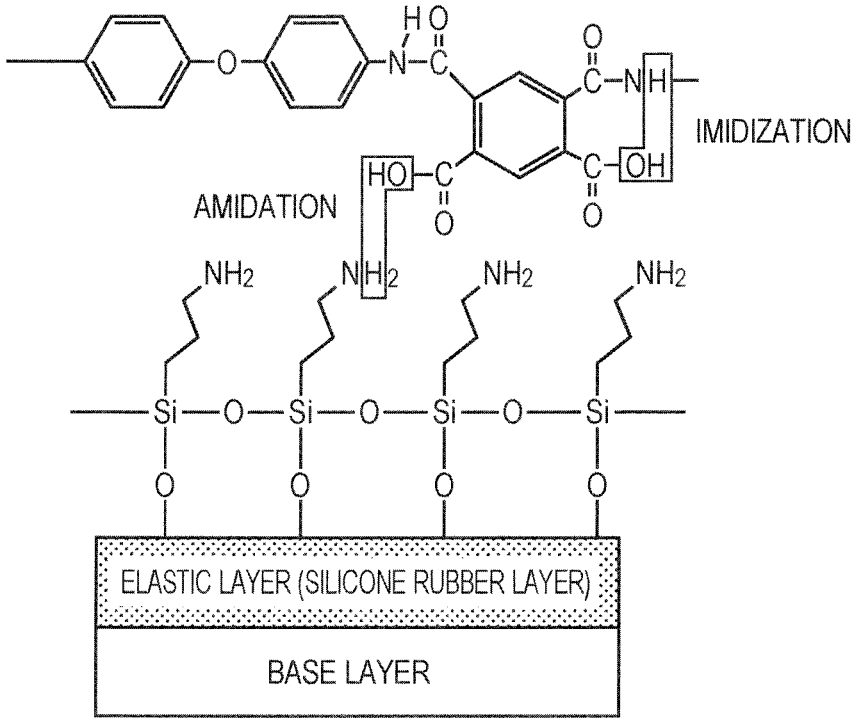
FIG. 6A is an explanatory view of a manufacturing step for the electrophotographic member according to the present invention.
Figure 6B:
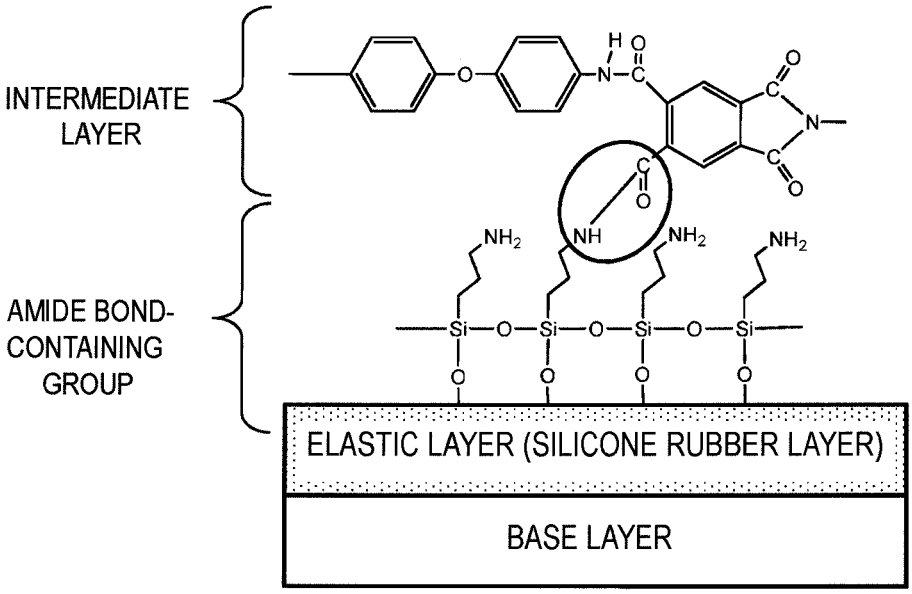
FIG. 6B is an explanatory view of a manufacturing step for the electrophotographic member according to the present invention.

Next, the primer containing the fluororesin and the polyamic acid is applied onto the amino group-containing polysiloxane (FIG. 6A), and the fluororesin particle dispersion described above is applied onto the primer to allow fluororesin particles to adhere onto the primer (not shown). After that, the fluororesin particles are melted and formed into a coating, to provide the release layer 2D. At this time, a carboxyl group in the polyamic acid in the primer or in the molecule of the aromatic polyimide or aromatic polyamideimide as a reaction product from the polyamic acid is subjected to a dehydration reaction (amidation) with an amino group in the polysiloxane by heat for melting the fluororesin particles. Thus, an amide bond (—NHCO—) is formed (see FIG. 6B). As a result, there is achieved a structure in which the aromatic polyimide or aromatic polyamideimide in the intermediate layer is bonded to the silicone rubber in the elastic layer with an amide bond-containing group, and in which a carbon atom constituting the amide bond is directly bonded to a carbon atom constituting an aromatic ring in the molecule of the aromatic polyimide or aromatic polyamideimide.

It is to be noted that the direct bonding of a carbon atom constituting the amide bond to a carbon atom constituting an aromatic ring in the molecule of the aromatic polyimide or aromatic polyamideimide may be confirmed by, for example, characteristic absorption derived from an aromatic amide group at 1,652 $cm^{-1}$ in analysis by FT-IR.

In the mixture of materials for forming the intermediate layer containing the polyamic acid and the fluororesin, it is advantageous from the viewpoint of the adhesiveness that the mixing ratio of the fluororesin to the polyamic acid be from 1:1 to 10:1 in terms of mass ratio. When such mass ratio is employed, the aromatic polyimide or the aromatic polyamideimide and the fluororesin are more sufficiently compatible with each other. As a result, a mutual adhesion force between the elastic layer and the release layer can be more improved.

In addition, the polyamic acid can reliably be present on the surface of the elastic layer containing an amino group, and hence reaction probability can be more sufficiently ensured between a carboxyl group in the polyamic acid and an amino group on the surface of the elastic layer. As a result, a mutual adhesion force between the intermediate layer and the elastic layer can be more improved.

That is, it is desired that the layer of the mixture of materials for forming the intermediate layer be baked in a state in which the aromatic polyimide or the aromatic polyamideimide, which is a reaction product from the polyamic acid, is compatible with the fluororesin, and in which the polyamic acid can be present on the surface of the elastic layer containing an amino group. With this, the elastic layer is bonded to the aromatic polyimide or aromatic polyamideimide in the intermediate layer with an aromatic amide bond-containing group. As a result, an electrophotographic member according to the present invention in which the elastic layer and the surface layer (release layer) exhibit high mutual adhesion is provided.

The present invention is hereinafter specifically described by way of Examples, but the present invention is not limited thereto.

EXAMPLE 1

(5-1) Step of Forming Elastic Layer of Fixing Film

As the base material 2A having an endless shape, a metal belt made of stainless steel measuring 240 mm in length, 40 μm in thickness, and 30 mm in outer diameter was prepared.

A rubber-based primer (trade name: X-33-174A, X-33-174B; manufactured by Shin-Etsu Chemical Co., Ltd.) was applied onto the outer peripheral surface of the metal belt with an applied width of 230 mm excluding 5 mm at the respective ends. The resultant was then placed in an electric oven and dried at 200° C. for 30 minutes, to form a primer layer. The thickness of the primer layer after the drying was set to 2 μm.

Next, an addition curing type liquid silicone rubber mixture to be used for forming the elastic layer 2B was prepared as described below. Specifically, an addition curing type liquid silicone rubber having a methyl group in its side chain (trade name: KE-1281-A, KE-1281-B; manufactured by Shin-Etsu Chemical Co., Ltd.) was prepared. Metal silicon in a crushed shape having an average particle size of 6.0 μm (trade name: M-Si#600; manufactured by KINSEI MATEC CO., LTD.) as a thermally conductive filler was mixed therein so that the ratio of the filler was 50 vol % with respect to the addition curing type liquid silicone rubber. After that, the mixture was stirred until the mixture became uniform, and then left in an atmosphere under reduced pressure to be defoamed.

The obtained addition curing type liquid silicone rubber mixture was applied onto the primer layer formed on the outer peripheral surface of the metal belt by the ring coating method described above (see FIG. 3), to form a coating having a thickness of 300 μm. Next, the resultant was placed in a heating oven and heated at a temperature of 140° C. for 10 minutes, to primarily vulcanize the coating of the addition curing type liquid silicone rubber mixture. The resultant was further heated at a temperature of 200° C. for 4 hours in the same oven, to secondarily vulcanize the coating of the addition curing type liquid silicone rubber mixture. Thus, a silicone rubber layer was formed.

(5-2) Step of Performing Surface Treatment on Elastic Layer 2B of Fixing Film Next, the surface of the elastic layer 2B formed on the metal belt 2A made of SUS was subjected to UV treatment. Specifically, a UV device was used to perform the treatment for about 100 seconds. With the treatment, the surface of the elastic layer 2B formed of a silicone rubber was rendered hydrophilic.

After the UV treatment, a liquid obtained by diluting with ethanol 3-aminopropyltriethoxysilane (trade name: KBE-903; manufactured by Shin-Etsu Chemical Co., Ltd.) five-fold in terms of weight ratio was applied as a silane coupling agent onto the surface of the elastic layer 2B by spraying so that the thickness after drying was 1.0 μm. The resultant was placed in an environment of normal temperature and normal humidity (temperature: 23° C., relative humidity: 45%) to be dried.

(5-3) Step of Preparing Coating Material for Forming Intermediate Layer and Forming Coating Thereof A solvent was prepared by mixing water, N-methylpyrrolidone, and furfuryl alcohol at a mass ratio of 6:1:1. 3.75 Parts by mass of a polyamic acid having a structure represented by the following structural formula (5) (manufactured by Du Pont-Mitsui Fluorochemicals Company, Ltd.) as a precursor of the aromatic polyimide, 15 parts by mass of a tetrafluoroethylene-perfluoroalkyl vinyl ether copolymer (PFA) (manufactured by Du Pont-Mitsui Fluorochemicals Company, Ltd.) as the fluororesin, 5 parts by mass of iron oxide (red iron oxide, particle size: 0.1 μm, trade name: R-516-L; manufactured by Titan Kogyo, Ltd.) as an inorganic filler, 1.25 parts by mass of trimethylnonanol (trade name: T2279; manufactured by TOKYO CHEMICAL INDUSTRY CO., LTD.) as a surfactant were added to 100 parts by mass of the solvent, followed by being mixed and dispersed therein uniformly. Thus, a mixture of materials for forming the intermediate layer was prepared.

It is to be noted that the PFA is a tetrafluoroethylene (TFE)/perfluoroalkyl vinyl ether (PAVE) copolymer resin or a TFE/perfluoroalkylvinyl (PAV) copolymer resin, and the ratio of an alkyl vinyl ether or alkylvinyl component is 9 mol % with respect to the copolymer resin.

The mixture of materials for forming the intermediate layer was applied by spraying so that the thickness after drying was 2.0 μm, and placed in an environment of normal temperature and normal humidity (temperature: 23° C., relative humidity: 45%) to be dried.

Structural Formula (5)

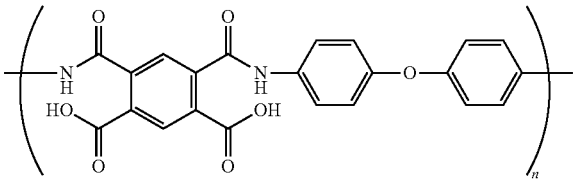

(5-4) Step of Forming Release Layer 2D

A PFA dispersion (trade name: EM-500; manufactured by Du Pont-Mitsui Fluorochemicals Company, Ltd.) to serve as the surface layer 2D was applied by spray coating onto a layer of the mixture of materials for forming the intermediate layer formed in the above-mentioned section (5-3). It is to be noted that the PFA is a tetrafluoroethylene (TFE)/perfluoroalkyl vinyl ether (PAVE) copolymer resin or a TFE/perfluoroalkylvinyl (PAV) copolymer resin, and the ratio of an alkyl vinyl ether or alkylvinyl component is 9 mol % with respect to the copolymer resin.

At this time, the dispersion was applied so as to achieve a wet surface by adjusting its discharge amount and the number of times of reciprocation, and was sufficiently leveled in an environment of normal temperature and normal humidity (temperature: 23° C., relative humidity: 45%) until the dispersion was dried.

It is to be noted that the layer of the mixture of materials for forming the intermediate layer and the PFA dispersion for forming the surface layer were applied so that the total coating thickness before baking and after the drying was 15 μm.

(5-5) Step of Baking Release Layer of Fixing Film

After the coating of the release layer was completed, the fixing film was placed in an electric oven and baked at 350° C. for 15 minutes. After that, the fixing film was cooled by air. Thus, a fixing film according to Example 1 was obtained. The thickness of the release layer was found to be 15 μm.

(5-6) Durability Test of Fixing Film

In order to evaluate the obtained fixing film for its durability in an environment of high temperature, the fixing film 2 thus obtained was mounted as a fixing member to a color laser printer (trade name: LBP9520C; manufactured by Canon Inc.) having the configuration illustrated in FIGS. 2A and 2B. Then, a solid while image was continuously printed on A4-size plain paper (trade name: CS814; manufactured by Canon Inc.) in a state in which the surface of the fixing film was heated to a temperature of 230° C. After the image was output on 500,000 sheets, the fixing film 2 was taken out from the fixing device and visually observed. No peeling was observed in the surface layer.

In addition, a fixing film separately prepared was mounted as a fixing member to the color laser printer, and a solid white image was output on 100,000 sheets by the same operation as described above. After that, the fixing film 2 was taken out from the fixing device and subjected to a peeling test between the release layer and the elastic layer by the following method.

A method for the peeling test is described with reference to FIG. 4.

Figure 4:
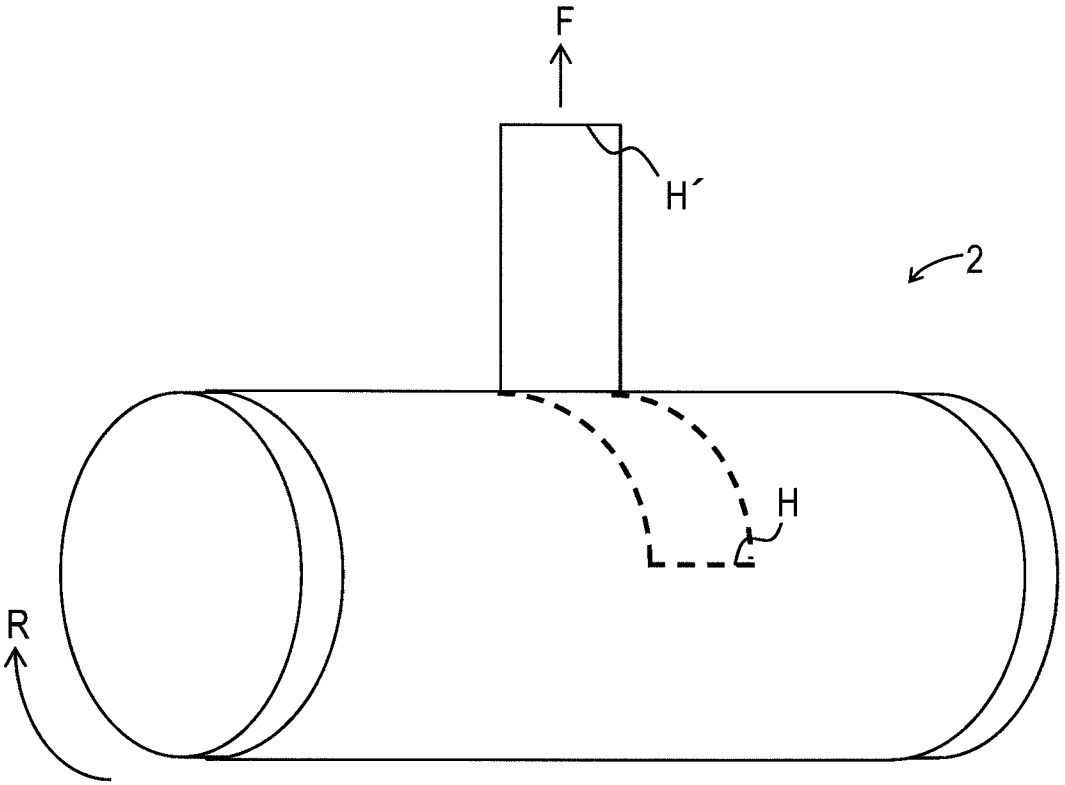
FIG. 4 is a schematic transverse sectional view of the fixing film illustrating a peeling end on a surface of the fixing film and a pealing direction in a peel strength test.

Specifically, a core cylinder (not shown) is placed in the fixing film 2, and is held by being externally clamped for its both ends with a bearing (not shown) rotatable in a direction R of FIG. 4. Next, a slit having a width of 25 mm is formed with a razor along the circumferential direction of the members of the fixing film 2 so that the slit reaches the surface of the elastic layer from the surface of the release layer. At this time, the indication of the slit depth is about from 40 to 200 μm. Next, one cutting is formed at the slit portion in the longitudinal direction of the fixing member, and the resultant edge is defined as a peeling end H. It is to be noted that the length of the slit in the circumferential direction is set to about from 50 to 90 mm from the peeling end H.

The surface layer and the elastic layer are forcibly peeled off from each other with a razor at an interface portion therebetween at the peeling end H, and the peeling end H is clamped with a force gauge of a peel tester. Next, the peeling end H is pulled from right above the rotation axis of the core cylinder in a perpendicular direction F at a rate of 50 mm/min, to peel a surface portion until the peeled length in the circumferential direction reaches 70 mm. At this time, it is important to keep the peeling direction represented by Symbol F at 90° with respect to the tangential direction of a main body of the fixing film 2 at the base of the peeling end H until the peeled length reaches at least 70 mm. As a specific method of keeping 90°, there is given the following method: the peeling end H is clamped with a force gauge of a peel tester so that the peeled surface portion forms 90° with respect to the tangential direction; and next, while the peeling end H is pulled from right above the rotation axis of the core cylinder in the perpendicular direction F at a constant moving speed (50 mm/min), the core cylinder may be allowed to rotate in the direction R of FIG. 4 so that its moving speed in the tangential direction of the core cylinder is equal to the moving speed in the perpendicular direction F. Specifically, when the outer diameter of the fixing film 2 is 30 mm, the angle of the peeling direction represented by Symbol F with respect to the tangential direction of the main body of the fixing film 2 at the base of the peeling end H can be kept at 90° by allowing the core cylinder to rotate at 0.53 rotation per minute (rpm). It is to be noted that reference numeral H' in FIG. 4 represents a peeling end in a peeling state.

The failure mode of the elastic layer is determined by evaluating a fractured surface formed by the above-mentioned peeling test in accordance with "Adhesives-Designation of main failure patterns" defined in Japanese Industrial Standard (JIS) K6866: 1999.

Adhesive failure: adhesive bond failure in which cleavage is visually observed to be present at the interface between an adhesive and an adherend Cohesive failure: bond deposit failure in which cleavage is visually observed to be present in an adhesive or an adherend In the present invention, the cohesive failure of the elastic layer means a failure in which cleavage of the fractured surface is visually observed to be present in the elastic layer.

The result was that the failure mode of the fixing film according to Example 1 after being subjected to the image output on 100,000 sheets was the cohesive failure of the elastic layer, and it was confirmed that the surface layer and the elastic layer were still firmly bonded to each other even after the image output on 100,000 sheets.

Further, the back surface of the peeled surface portion was subjected to measurement using a Fourier transform near-infrared/mid-infrared/far-infrared spectroscopic analyzer (trade name: FRONTIER FT-IR/NIR/MIR; manufactured by PerkinElmer, Inc.) and an infrared microscopic imaging system (Spotlight 400 type; manufactured by PerkinElmer, Inc.) in combination, and its infrared spectrum was obtained. Specifically, a linear MCT array detector (trade name: Duet detector; manufactured by PerkinElmer, Inc.) was used as a detector to perform the measurement in an environment of a temperature of 25° C. and a humidity of 40%.

The measurement region was set to an ordinary infrared region of from 4,000 $cm^{-1}$ to 600 $cm^{-1}$, the resolution was set to 4 $cm^{-1}$, and scanning was performed once.

The result was that IR peaks were detected at 1,022/cm and 1,260/cm, which were derived from silicone, at 1,153/cm and 1,210/cm, which were derived from a fluororesin, at 1,380/cm, 1,503/cm, 1,721/cm, and 1,774/cm, which were derived from an aromatic polyimide, and at 1,652/cm, which was derived from an aromatic amide group.

The evaluation results are shown in Table 1.

It is to be noted that the Symbol "Y" for the "result of FT-IR measurement" in Table 1 means that IR peaks were detected at 1,022/cm and 1,260/cm, which were derived from silicone, at 1,153/cm and 1,210/cm, which were derived from a fluororesin, at 1,380/cm, 1,503/cm, 1,721/cm, and 1,774/cm, which were derived from an aromatic polyimide, and at 1,652/cm, which was derived from an aromatic amide group, as described above.

EXAMPLE 2

A fixing film according to Example 2 was produced in the same manner as in Example 1 with the exception that polytetrafluoroethylene (PTFE) was used as the fluororesin in the step of preparing an adhesive primer liquid instead of the tetrafluoroethylene-perfluoroalkyl vinyl ether copolymer (PFA), and the PFA dispersion was changed to a PTFE dispersion (trade name: 852N-201; manufactured by Du Pont-Mitsui Fluorochemicals Company, Ltd.) in the step of forming the release layer 2D. The thickness of the release layer was found to be 15 μm.

The fixing film was subjected to the durability test in the same manner as in Example 1.

In addition, the fixing film was subjected to the durability test in 100,000 sheets in the same manner as in Example 1, and then evaluated for a mutual adhesive force between the release layer and the elastic layer. Further, the peeled surface was subjected to FT-IR measurement in the same manner as in Example 1. The results are shown in Table 1.

EXAMPLE 3

A fixing film according to Example 3 was produced in exactly the same manner as in Example 1 with the exception that a tetrafluoroethylene-hexafluoropropylene copolymer (FEP) was used as the fluororesin in the step of preparing an adhesive primer liquid instead of the tetrafluoroethylene-perfluoroalkyl vinyl ether copolymer (PFA), and the PFA dispersion was changed to an FEP dispersion (trade name: 856N-200; manufactured by Du Pont-Mitsui Fluorochemicals Company, Ltd.) in the step of forming the release layer 2D. The thickness of the release layer was found to be 15 μm.

The fixing film was subjected to the durability test in the same manner as in Example 1.

In addition, the fixing film was subjected to the durability test in 100,000 sheets in the same manner as in Example 1, and then evaluated for a mutual adhesive force between the release layer and the elastic layer. Further, the peeled surface was subjected to FT-IR measurement in the same manner as in Example 1. The results are shown in Table 1.

EXAMPLE 4

A fixing film according to Example 4 was produced in exactly the same manner as in Example 1 with the exception that 3-aminopropylmethyldiethoxysilane (trade name: SIA0605.0; manufactured by Gelest, Inc.) was used as the silane coupling agent in the step of performing surface treatment on the elastic layer 2B instead of 3-aminopropyltriethoxysilane. The thickness of the release layer was found to be 15 μm.

The fixing film was subjected to the durability test in the same manner as in Example 1.

In addition, the fixing film was subjected to the durability test in 100,000 sheets in the same manner as in Example 1, and then evaluated for a mutual adhesive force between the release layer and the elastic layer. Further, the peeled surface was subjected to FT-IR measurement in the same manner as in Example 1. The results are shown in Table 1.

EXAMPLE 5

A fixing film 2 according to Example 5 was produced in exactly the same manner as in Example 1 with the exception that 4-aminobutyltriethoxysilane (trade name: SIA0587.0; manufactured by Gelest, Inc.) was used as the silane coupling agent in the step of performing surface treatment on the elastic layer 2B instead of 3-aminopropyltriethoxysilane. The thickness of the release layer was found to be 15 μm.

The fixing film was subjected to the durability test in the same manner as in Example 1.

In addition, the fixing film was subjected to the durability test in 100,000 sheets in the same manner as in Example 1, and then evaluated for a mutual adhesive force between the release layer and the elastic layer. Further, the peeled surface was subjected to FT-IR measurement in the same manner as in Example 1. The results are shown in Table 1.

COMPARATIVE EXAMPLE 1

A fixing film according to Comparative Example 1 was produced in exactly the same manner as in Example 1 with the exception that vinyltriethoxysilane (trade name: Z-6519; manufactured by Dow Corning Toray Co., Ltd.) was used as the silane coupling agent in the step of performing surface treatment on the elastic layer 2B instead of 3-aminopropyltriethoxysilane. The thickness of the release layer was found to be 15 μm.

The fixing film was subjected to the durability test in the same manner as in Example 1.

In addition, the fixing film was subjected to the durability test in 100,000 sheets in the same manner as in Example 1, and then evaluated for a mutual adhesive force between the release layer and the elastic layer. Further, the peeled surface was subjected to FT-IR measurement in the same manner as in Example 1. The result was that the back surface of the surface portion showed IR peaks derived from a fluororesin and an aromatic polyimide group and the peeled surface on the elastic layer side showed IR peaks derived from silicone, but there was found no IR peaks derived from an aromatic amide.

The results are shown in Table 1. It is to be noted that the Symbol "N" for the "result of FT-IR measurement" in Table 1 means that the back surface of the peeled surface portion showed IR peaks derived from a fluororesin and an aromatic polyimide group and the peeled surface on the elastic layer side showed IR peaks derived from silicone, but there was found no IR peaks derived from an aromatic amide, as described above.

EXAMPLE 6

The fixing film 2 according to Example 6 was produced in exactly the same manner as in Example 1 with the exception that 12.5 parts by mass of the polyamic acid and 6.25 parts by mass of the tetrafluoroethylene-perfluoroalkyl vinyl ether copolymer (PFA) as the fluororesin were added in the step of preparing an adhesive primer liquid. The thickness of the release layer was found to be 15 μm.

The fixing film was subjected to the durability test in the same manner as in Example 1.

In addition, the fixing film was subjected to the durability test in 100,000 sheets in the same manner as in Example 1, and then evaluated for a mutual adhesive force between the release layer and the elastic layer. Further, the peeled surface was subjected to FT-IR measurement in the same manner as in Example 1. The results are shown in Table 1.

EXAMPLE 7

The fixing film according to Example 7 was produced in exactly the same manner as in Example 1 with the exception that 1.25 parts by mass of the polyamic acid and 17.5 parts by mass of the tetrafluoroethylene-perfluoroalkyl vinyl ether copolymer (PFA) as the fluororesin were added in the step of preparing an adhesive primer liquid. The thickness of the release layer was found to be 15 μm.

The fixing film was subjected to the durability test in the same manner as in Example 1.

In addition, the fixing film was subjected to the durability test in 100,000 sheets in the same manner as in Example 1, and then evaluated for a mutual adhesive force between the release layer and the elastic layer. Further, the peeled surface was subjected to FT-IR measurement in the same manner as in Example 1. The results are shown in Table 1.

COMPARATIVE EXAMPLE 2

A fixing film according to Comparative Example 2 was produced in exactly the same manner as in Example 1 with the exception that a polyamic acid having a structure represented by the following structural formula (6) prepared with reference to the invention disclosed in Japanese Patent Application Laid-Open No. 2007-314583 was used as a precursor of an alicyclic polyimide in the step of preparing an adhesive primer liquid. The thickness of the release layer was found to be 15 μm.

The fixing film was subjected to the durability test in the same manner as in Example 1.

In addition, the fixing film was subjected to the durability test in 100,000 sheets in the same manner as in Example 1, and then evaluated for a mutual adhesive force between the release layer and the elastic layer. Further, the peeled surface was subjected to FT-IR measurement in the same manner as in Example 1. The results are shown in Table 1.

Structural Formula (6)

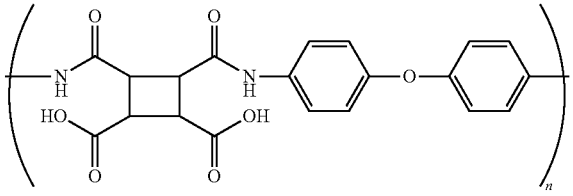

EXAMPLE 8

A fixing film according to Example 8 was produced in exactly the same manner as in Example 1 with the exception that a polyamic acid represented by the following structural formula (7) was used as a precursor of an aromatic polyamideimide in the step of preparing an adhesive primer liquid. The thickness of the release layer was found to be 15 μm.

The fixing film was subjected to the durability test in the same manner as in Example 1.

In addition, the fixing film was subjected to the durability test in 100,000 sheets in the same manner as in Example 1, and then evaluated for a mutual adhesive force between the release layer and the elastic layer. Further, the peeled surface was subjected to FT-IR measurement in the same manner as in Example 1. The results are shown in Table 1.

Structural Formula (7)

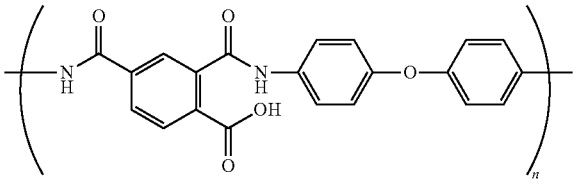

COMPARATIVE EXAMPLE 3

A fixing film according to Comparative Example 3 was produced in exactly the same manner as in Example 1 with the exception that a phosphate group-containing fluororesin aqueous primer for a rubber (manufactured by Du Pont-Mitsui Fluorochemicals Company, Ltd.) according to the invention disclosed in Japanese Patent Application Laid-Open No. 2005-212318 was used in the step of preparing an adhesive primer liquid and forming the intermediate layer 2C.

The fixing film was subjected to the durability test in the same manner as in Example 1.

In addition, the fixing film was subjected to the durability test in 100,000 sheets in the same manner as in Example 1, and then evaluated for a mutual adhesive force between the release layer and the elastic layer. Further, the peeled surface was subjected to FT-IR measurement in the same manner as in Example 1. The results are shown in Table 1.

EXAMPLE 9

In the step of forming the elastic layer of the fixing film in Example 1, 100 parts by mass of a condensation-curable silicone rubber (trade name: KE-4901-W; manufactured by Shin-Etsu Astech Co., Ltd.) was used instead of the addition curing type liquid silicone rubber, and 10 parts by mass of an aminoethylaminopropylmethoxysiloxane-dimethylsiloxane copolymer (trade name: ATM-1322; manufactured by Gelest, Inc.) were mixed thereto. The mixture was sufficiently stirred and defoamed. After that, the obtained mixture was formed into a coating in the same manner as in Example 1, and left at normal temperature and normal humidity (23° C./45%) for 3 days to be naturally cured. Thus, the elastic layer 2B was obtained.

Then, a fixing film according to Example 9 was produced in the same manner as in Example 1 with the exception that the surface of the elastic layer was not subjected to treatment with an aminosilane coupling agent.

The fixing film was subjected to the durability test in the same manner as in Example 1.

In addition, the fixing film was subjected to the durability test in 100,000 sheets in the same manner as in Example 1, and then evaluated for a mutual adhesive force between the release layer and the elastic layer. Further, the peeled surface was subjected to FT-IR measurement in the same manner as in Example 1. The results are shown in Table 1.

TABLE 1

| | | | Intermediate layer | | | | Evaluation result | | |
|---|---|---|---|---|---|---|---|---|---|
| | Elastic Layer | Functional group of silane coupling agent | Kind of polyamic acid | Kind of F resin | Mass ratio (F resin/ polyamic acid) | Surface layer | Peeling test | Endurance sheet number | FT-IR measure-ment |
| Example 1 | Addition curable silicone rubber | Amino group (structural formula 1) | Aromatic polyamic acid | PFA | 4.0 | PFA | Cohesive failure of elastic layer | 500K or more | Y |
| Example 2 | Addition curable silicone rubber | Amino group (structural formula 1) | Aromatic polyamic acid | PTFE | 4.0 | PTFE | Cohesive failure of elastic layer | 500K or more | Y |
| Example 3 | Addition curable silicone rubber | Amino group (structural formula 1) | Aromatic polyamic acid | FEP | 4.0 | FEP | Cohesive failure of elastic layer | 500K or more | Y |
| Example 4 | Addition curable silicone rubber | Amino group (structural formula 1) | Aromatic polyamic acid | PFA | 4.0 | PFA | Cohesive failure of elastic layer | 500K or more | Y |
| Example 5 | Addition curable silicone rubber | Amino group (structural formula 2) | Aromatic polyamic acid | PFA | 4.0 | PFA | Cohesive failure of elastic layer | 499K | Y |
| Comparative Example 1 | Addition curable silicone rubber | Vinyl group | Aromatic polyamic acid | PFA | 4.0 | PFA | Interfacial peeling | 198K | N |
| Example 6 | Addition curable silicone rubber | Amino group (structural formula 1) | Aromatic polyamic acid | PFA | 0.5 | PFA | Cohesive failure of elastic layer | 441K | Y |
| Example 7 | Addition curable silicone rubber | Amino group (structural formula 1) | Aromatic polyamic acid | PFA | 14.0 | PFA | Cohesive failure of elastic layer | 450K | Y |
| Comparative Example 2 | Addition curable silicone rubber | Amino group (structural formula 1) | Aromatic polyamic acid | PFA | 4.0 | PFA | Interfacial peeling | 270K | N |
| Example 8 | Addition curable silicone rubber | Amino group (structural formula 1) | Aromatic polyamideimide acid | PFA | 4.0 | PFA | Cohesive failure of elastic layer | 488K | Y |
| Comparative Example 3 | Addition curable silicone rubber | Amino group (structural formula 1) | — | PFA (containing phosphate group) | — | PFA | Interfacial peeling | 235K | N |
| Example 9 | Condensation curable rubber containing amino group | — | Aromatic polyamic acid | PFA | 4.0 | PFA | Cohesive failure of elastic layer | 473K | Y |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-260363, filed Dec. 17, 2013, which is hereby incorporated by reference herein in its entirety.

What is claimed is:

1. An electrophotographic member, comprising:

an elastic layer comprising a silicone rubber;

an intermediate layer comprising at least one of an aromatic polyimide and an aromatic polyamideimide, and a fluororesin; and a surface layer comprising a fluororesin, wherein:

the aromatic polyimide or the aromatic polyamideimide is bonded to the elastic layer through an amide bond-containing group, and a carbon atom constituting the amide bond is directly bonded to a carbon atom constituting an aromatic ring in a molecule of the aromatic polyimide or aromatic polyamideimide.

2. The electrophotographic member according to claim 1, wherein the amide bond is formed by forming on a surface of the elastic layer containing an amino group a layer of a mixture of materials for forming the intermediate layer containing a polyamic acid and the fluororesin, and then allowing an acid group of the polyamic acid to react with the amino group in imidization of the polyamic acid.

3. The electrophotographic member according to claim 2, wherein the amino group is introduced by treating the surface of the elastic layer with an aminosilane coupling agent.

4. The electrophotographic member according to claim 3, wherein the aminosilane coupling agent comprises at least one selected from a silane coupling agent having a structure represented by the following structural formula (1) and a silane coupling agent having a structure represented by the following structural formula (2):

Structural Formula (1)

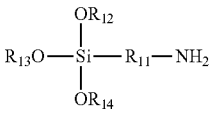

Structural Formula (2)

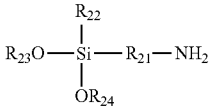

in the structural formulae (1) and (2), $R_{11}$, $R_{21}$, and $R_{22}$ each represent an alkylene group having 1 to 3 carbon atoms, and $R_{12}$, $R_{13}$, $R_{14}$, $R_{23}$, and $R_{24}$ each independently represent a hydrogen atom or an alkyl group having 1 or 2 carbon atoms.

5. The electrophotographic member according to claim 1, wherein the silicone rubber comprises a cured product of an addition curing type silicone rubber.

6. The electrophotographic member according to claim 2, wherein the amino group comprises an amino group existing in a molecule of the silicone rubber.

7. The electrophotographic member according to claim 2, wherein a ratio of the fluororesin to the polyamic acid in the mixture of materials for forming the intermediate layer falls within a range of from 1:1 to 10:1 in terms of mass ratio.

8. The electrophotographic member according to claim 1, wherein the surface layer contains as the fluororesin at least one selected from the group consisting of polytetrafluoroethylene (PTFE), a tetrafluoroethylene-perfluoroalkyl vinyl ether copolymer (PFA), and a tetrafluoroethylene-hexafluoropropylene copolymer (FEP).

9. The electrophotographic member according to claim 1, wherein the intermediate layer contains as the fluororesin at least one selected from the group consisting of polytetrafluoroethylene (PTFE), a tetrafluoroethylene-perfluoroalkyl vinyl ether copolymer (PFA), and a tetrafluoroethylene-hexafluoropropylene copolymer (FEP).

10. A fixing device, comprising:

a fixing member;

a heating device for the fixing member; and a pressing member arranged so as to face the fixing member, wherein at least one of the fixing member and the pressing member comprises the electrophotographic member according to claim 1.

11. An electrophotographic image forming apparatus, comprising the fixing device according to claim 10.

12. A method of manufacturing an electrophotographic member comprising: an elastic layer comprising a silicone rubber; an intermediate layer comprising at least one of an aromatic polyimide and an aromatic polyamideimide, and a fluororesin; and a surface layer comprising a fluororesin, the method comprising the steps of:

(1) preparing an elastic layer including an amino group on a surface thereof and comprising a silicone rubber;

(2) forming on the surface of the elastic layer a layer of a mixture of materials for forming an intermediate layer including a polyamic acid as a precursor of an aromatic polyimide or an aromatic polyamideimide, and a fluororesin, followed by forming on the layer of the mixture of materials for forming the intermediate layer a layer of a fluororesin particle dispersion; and (3) imidizing the polyamic acid in the layer of the mixture of materials for forming the intermediate layer, and melting fluororesin particles in the layer of the fluororesin particle dispersion to form a fluororesin layer, the step (3) comprising the step of allowing an acid group directly bonded to a carbon atom constituting an aromatic ring in a molecule of the polyamic acid to react with the amino group on the surface of the elastic layer when imidizing the polyamic acid.

* * * * *